US008479693B2

(12) United States Patent
Galli et al.

(10) Patent No.: US 8,479,693 B2
(45) Date of Patent: Jul. 9, 2013

(54) FLEXIBLE ROTARY DISC ACTUATOR FOR INLET AND EXHAUST-VALVE ARRANGEMENT FOR AN INTERNAL-COMBUSTION ENGINE

(75) Inventors: Luis Antonio Fonseca Galli, Campinas-SP (BR); Sergio Stefano Guerreiro, Sorocaba-SP (BR)

(73) Assignee: ThyssenKrupp Metalurgica Campo Limpo Ltda, Campo Limpo Paulista-SP (BR)

( * ) Notice: Subject to any disclaimer, the term of this patent is extended or adjusted under 35 U.S.C. 154(b) by 786 days.

(21) Appl. No.: 12/596,161

(22) PCT Filed: Apr. 17, 2008

(86) PCT No.: PCT/IB2008/000940

§ 371 (c)(1),
(2), (4) Date: Dec. 1, 2009

(87) PCT Pub. No.: WO2008/129392

PCT Pub. Date: Oct. 30, 2008

(65) Prior Publication Data

US 2010/0126456 A1 May 27, 2010

(30) Foreign Application Priority Data

Apr. 19, 2007 (DE) ..... 10 2007 018 433
Jul. 24, 2007 (EP) ..... 07014511

(51) Int. Cl.
*F01L 7/06* (2006.01)

(52) U.S. Cl.
USPC ..... 123/80 D; 123/190.15; 123/190.14

(58) Field of Classification Search
USPC ..... 123/80 R, 80 BA, 80 BB, 80 D, 123/188.1, 190.1, 190.14–190.17, 188.8, 123/75 D, 73 D
See application file for complete search history.

(56) References Cited

U.S. PATENT DOCUMENTS

| | | | | | |
|---|---|---|---|---|---|
| 2,457,206 | A | * | 12/1948 | Carlson | 123/80 DA |
| 4,838,220 | A | * | 6/1989 | Parsons | 123/190.14 |
| 5,673,663 | A | | 10/1997 | Kim | |
| 5,908,016 | A | * | 6/1999 | Northam et al. | 123/190.17 |
| 5,996,544 | A | | 12/1999 | Bartos | 123/190.13 |

FOREIGN PATENT DOCUMENTS

| | | |
|---|---|---|
| DE | 358912 | 9/1922 |
| EP | 0285363 A | 9/1990 |
| FR | 1017795 | 12/1952 |
| FR | 2356812 | 1/1978 |
| GB | 221942 | 9/1924 |
| JP | 2005264903 | 9/2005 |

* cited by examiner

*Primary Examiner* — Noah Kamen
*Assistant Examiner* — Hung Q Nguyen
(74) *Attorney, Agent, or Firm* — Andrew Wilford

(57) ABSTRACT

An inlet and exhaust valve arrangement for an internal combustion engine with a valve disk has at least one passage opening and is arranged in a cylinder head drivable by a shaft in a rotating manner and having a valve seat assigned to a top of the valve disk and at least a port that during rotation of the valve disk is cyclically exposed and closed again by at least one passage opening. The valve disk and the assigned valve seat starting from the shaft run in curve or taper at an angle toward a bottom of the valve disk. The valve disk is elastically bendable such that during rotation the valve disk is deflected and an edge of the valve disk is moved toward the valve seat to define therewith a self-sealing valve arrangement.

15 Claims, 6 Drawing Sheets

Figures 1A, 1B:
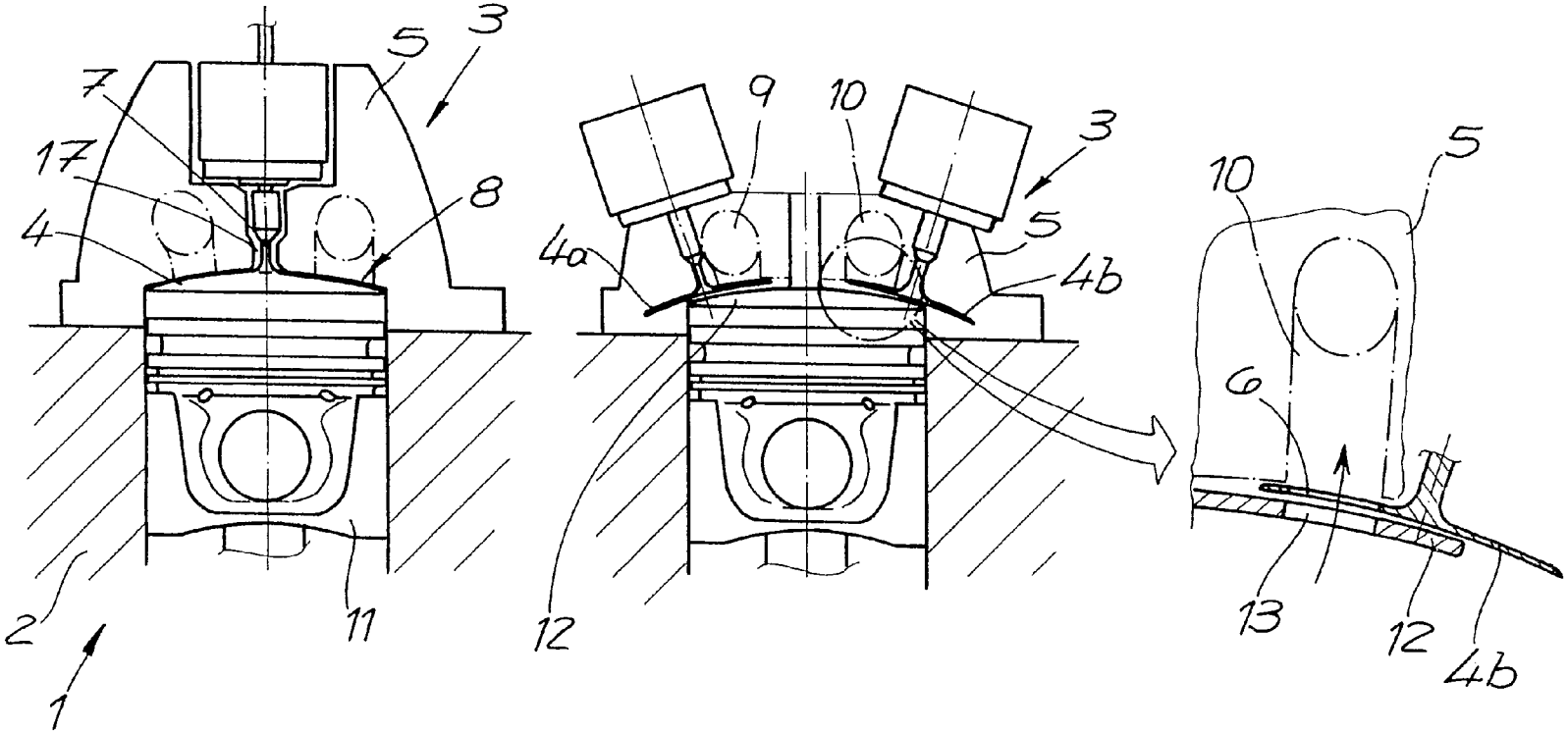

Fig. 3a
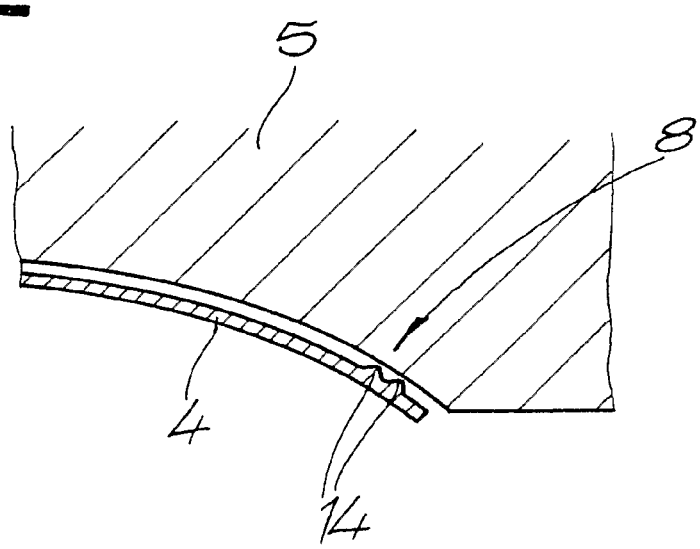
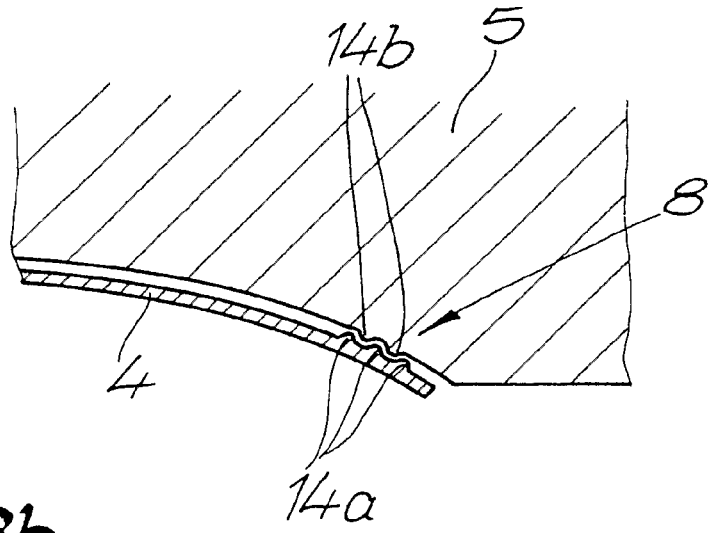
Fig. 3b

FLEXIBLE ROTARY DISC ACTUATOR FOR INLET AND EXHAUST-VALVE ARRANGEMENT FOR AN INTERNAL-COMBUSTION ENGINE

CROSS REFERENCE TO RELATED APPLICATIONS

This application is the US national phase of PCT application PCT/IB2008/000940, filed 17 Apr. 2008, published 30 Oct. 2008 as WO2008/129392, and claiming the priority of German patent application 102007018433.8 itself filed 19 Apr. 2007 and PCT patent application PCT/IB2008/000940 itself filed 17 Apr. 2008, whose entire disclosures are herewith incorporated by reference.

The invention relates to an inlet and exhaust valve arrangement for an internal combustion engine with a valve disc which has at least one passage opening and is arranged in a cylinder head drivable by a shaft in a rotating manner wherein the cylinder head has a valve seat assigned to the top of the valve disc and at least a port which during a rotational movement of the valve disc is cyclically exposed by the at least one passage opening and closed again and wherein the valve disc and the assigned valve seat starting from the shaft run in a curved or taper angled way in the direction of the bottom of the valve disc. The object of the invention is also an internal combustion engine, more preferably for a motor vehicle.

In practice, spring-controlled valves are usually employed in 4-stroke internal combustion engines for motor vehicles ("Bosch, Kraftfahrtechnisches Taschenbuch", 26th Edition, 2007, Page 480 ff). With the conventional spring-controlled valves the maximum engine speed is limited by the kinematics of the stroke movement of the valves and the inertia of the springs and valve control by way of a camshaft is also expensive.

Different advancements of the traditional spring-controlled valves are known from practice. It is also important to mention two evolutions of the traditional valve control: the VVT—Variable Valve Train and the EVC—Electronic Valve Control.

In the VVT system (Variable Valve Train system) the opening and closing of the valves can be adjustable in function of the engine rotation and its specific application. In case the engine has more than one valve to intake and to exhaust the gases, a hydraulic system can be coupled in order to turn on or off one of these valves, depending on the engine application. As an example an engine with two intake valves and two exhaust valves can flexibly be operated just with one intake valve and one exhaust valve or both depending on the engine rotation and/or application.

The EVC system (Electronic Valve Control system) has an electromechanical device to control the valve opening and closing. This electromechanical device works as a combination of a solenoid and a mechanical spring controlled by an electronic system. This electronic system is very flexible and can open and close the intake and exhaust valves according with the engine application requirement.

An inlet and exhaust valve arrangement with the features described at the outset, which is also called a rotary disc valve, is known from the publication U.S. Pat. No. 5,673,663 wherein the valve disc has the shape of a spherical shell and is connected to an electronically controlled electric motor for the rotating drive by way of a gearing. The valve disc has a passage opening and the cylinder head two inlet and two exhaust ports each. Through this arrangement it is achieved that with a full 4-stroke cycle of the 4-stroke internal combustion engine the valve disc merely completes half a turn at a comparatively low rotational speed.

Publication JP 2005-264903 deals with the problem of sealing and the friction with an inlet and exhaust valve arrangement with the features described at the outset. The valve disc is arched and arranged between a cylinder cap arranged in the direction of an interior space of a cylinder and the cylinder head. For sealing, the cylinder cap is pushed against the valve disc by an elastic sleeve arranged within the cylinder. Applying force to the valve disc can lead to increased friction and wear of the inlet and exhaust valve arrangement designed as rotary disc valve. Developments of rotary disc valves where arched valve discs are guided in an intermediate space within the cylinder head are also known from the publications DE 195 35 920 C2 and DE 43 12 492 A1, wherein separate sealing rings are provided for sealing.

The publication EP 0 285 363 B1 relates to an inlet and exhaust valve arrangement with the features described at the outset, wherein valve disc and the assigned valve seat run in a taper angled way starting from the shaft in the direction of the bottom of the valve disc. In order to reduce the major friction that occurs in the compression phase it is provided that through a torsional spring between the shaft and the assigned drive the rotational speed is reduced at times through modulation of the rotational speed. The elasticity of the torsional spring however can also result in uncontrolled displacement of the inlet and exhaust timing depending on the operating parameters and the friction that occurs.

With the known inlet and exhaust valve arrangements which are designed as rotary disc valve a comparatively simple construction is obtained compared with conventional spring-controlled valves. Since the opening and closing of the gas inlet and exhaust openings can take place through a rotational movement coupled to the engine speed the restrictions with regard to the maximum engine speed known from spring-controlled valves are not applicable. In contrast with spring-controlled valves where the pressure prevailing during compression and after ignition is absorbed by the valve seats assigned to the valves which are closed in these phases, the sealing of the rotary slide arrangement and the friction that occurs make huge demands on the technical design.

In view of this background the invention is based on the object of stating an inlet and exhaust valve arrangement for an internal combustion engine with the features described at the outset which guarantees good sealing and has good wear resistance.

According to the invention the object is solved in that the valve disc is elastically bendable whereby during the rotational movement the valve disc is deflected and the edge of the valve disc is moved in the direction on the valve seat defining a self-sealing valve arrangement.

The principle of the invention is the self-sealing of the system during the engine running and this capability is obtained by using of a flexible disc that bends when submitted to a rotation.

In respect to conventional spring-controlled valves in a combustion engine the present invention allows to eliminate or simplify several components like a timing belt, a camshaft and a mechanical valve train. In addition the valve arrangement according to the invention can contribute to lightweight construction of the combination engine and to a reduction of friction losses in the gas flow.

Between the valve seat and the valve disc a small gap can be provided which is reduced or at least largely closed through the movement of the edge of the valve disc in the direction of the valve and the sealing can be enhanced.

The cyclical exposure of the at least one port through the passage opening enables the gas exchange in a cylinder of the internal combustion engine. In the process, the valve disc usually runs with half of the motor rotation speed (revolutions per minute RPM) of the internal combustion engine.

Within the scope of the invention, circumferential sealing lips can be provided on the top of the valve disc and/or on the valve seat. The sealing lips, which are preferably designed with the same material of the valve disc or the valve seat as a protrusion material-positive or as an engraved material-negative molded-on the corresponding contact surfaces along the gap between the valve seat and the valve disc which contribute for the reduction of the blow-by from the combustion bowl.

Also an outflow of lubricant which can be arranged between the valve disc and the valve seat can be reduced with the use of these lips.

Within the scope of a preferred further development of the invention it is provided that at the top of the valve disc and on the valve seat interacting sealing lips are arranged which form a labyrinth seal. Through such an arrangement, particularly effective sealing can be achieved without the occurring friction being significantly increased.

Gas from the surroundings of the valve disc or preferably a lubricant, for example oil for the lubrication of the internal combustion engine, is usually located in a narrow gap, at least provided in sections between the valve disc and the valve seat. The gas or the oil as fluid forms a lubricating film during the rotation of the valve disc. To always guarantee a lubricating film of a lubricant between the valve seat and the valve disc a duct or a gap for the passage of lubricant can be provided between the shaft and an assigned accommodation of the cylinder head, wherein depending on the embodiment of the inlet and exhaust valve arrangement, even a minor manufacturing and assembly-related gap can be adequate. However, in addition to this, ducts or gaps which have specially been provided for lubrication can also be present.

Within the scope of a preferred development of the invention wedge surfaces can be arranged on the top of the valve disc and/or the valve seat which during the rotational movement bring about a hydrodynamic slide bearing. To achieve effective hydrodynamic bearing the wedge surfaces should rise in the direction of the movement, i.e. in circumferential direction, or at least obliquely to the movement direction.

Related to the hydrodynamic effect generation, engraved dimples as small cavities can be assigned to the valve disc and/or valve seat contact surfaces in order to generate the lift force required for friction losses decreasing.

In order for the valve disc to have adequate pliability and elasticity, the mentioned disc is typically between 0.2 mm and 2 mm, preferably between 0.5 mm and 1.5 mm thick depending on the material used. Suitable are all materials that have adequate load capacity and flexibility. In addition to metallic materials such as titanium or titanium alloys, carbon fiber materials or carbon fiber reinforced materials are particularly suitable. The shaft directly follows the valve disc while shaft and valve disc within the scope of the invention can be manufactured of one piece or in different materials depending on the technical requirements for the related parts, valve disc and drive shaft.

Within the scope of the invention a surface coating of the valve disc and/or the valve seat can also be provided which brings about an increase of the wear resistance and/or a reduction of the friction upon direct material contact between valve disc and valve seat. In this way a coating based on high temperature resistance materials, like nitrides, oxides or carbides of alloys based on elements like chromium, aluminum or titanium can be applied to the surface for instance by means of a plasma method, PVD (Physical Vapor Deposition) or PACVD (Plasma Assisted Chemical Vapor Deposition). In the case of coating the surfaces to reduce wear and friction losses, the coating thickness is considered to be in the range of 1 micron to 20 microns. By controlling the coating method it is also possible to coat diamond like carbon (DLC) hard material having a high content of $sp^3$ carbon compounds and thus diamond-like strength. The component of the $sp^3$ bonds, graphite-like $sp^2$ bonds which can contribute to a particularly good lubrication and of additional constituents of the coating such as hydrogen as termination of free bonding, the microscopic structure of the coating and the linkage to the carrier material can be adjusted in a wide range to corresponding requirements. In the case of DLC coating, preferably the surface of the valve that is not facing the firing chamber is coated with this material. The surface facing the firing chamber is more likely to be coated with a temperature resistant coating with low friction coefficient like described above. The valve seat shall also have a low friction surface.

Within the scope of a preferred development of the invention it is provided that the inlet and exhaust valve arrangement comprises a control disc with at least a control opening, wherein by the position of the control opening relative to the passage opening the flow cross section is adjustable. The control disc can be arranged on the cylinder head or on the valve disc in a rotating way relative to the valve seat. With an arrangement on the cylinder head, maximum gas passage is made possible when the control opening completely exposes the port. Through rotation of the control disc and a partial coverage of the port the flow cross section can then be reduced. Accordingly, the control disc can also be arranged on the valve disc wherein the control disc and the valve disc can be jointly driven in a rotating way. The flow cross section can then be changed by rotating the control opening relative to the flow opening (port opening). As a matter of principle, free rotate-ability of the control disc can also be provided wherein the rotary movements of the control disc and the valve disc then have to be matched to each other to suit the respective requirements.

The use of the control disc allows to adjust the cross section area of the inlet and exhaust ports by an engine ECU (Electronic Control Unit) to different applications for the same engine like predefined setting for "economic", "city tour", "highway", "sports", etc.

The object of the invention is also an internal combustion engine, more preferably for motor vehicles, with the inlet and exhaust arrangement described before, wherein the cylinder head is fitted on an engine block with at least one cylinder. Here, without restrictions, each cylinder can be assigned with exactly one valve disc or several valve discs. If merely one valve disc is provided for one cylinder at least one inlet opening and one exhaust opening is cyclically opened and closed through the valve disc. Here, the inlet opening is preferably arranged in the direction of rotation approximately 90 degree after the exhaust opening. If several valve discs are assigned to a cylinder, each of these can be assigned exactly to one inlet or exhaust opening.

Several valve discs are preferably driven via a gearing by a common control shaft. Each of the shafts assigned to a valve disc can for example have a bevel gear which intermeshes with a bevel gear arranged on the control shaft.

There is also the flexibility in terms of assembly in which each of the valve discs have their own driveshaft and these driveshaft can be geared by electronic electric engines. The ECU (Electronic Control Unit) allows the intelligent opening/close of the inlet and exhaust ports and the turn-on/turn-off of the discs, depending on the engine application.

Figure 2:
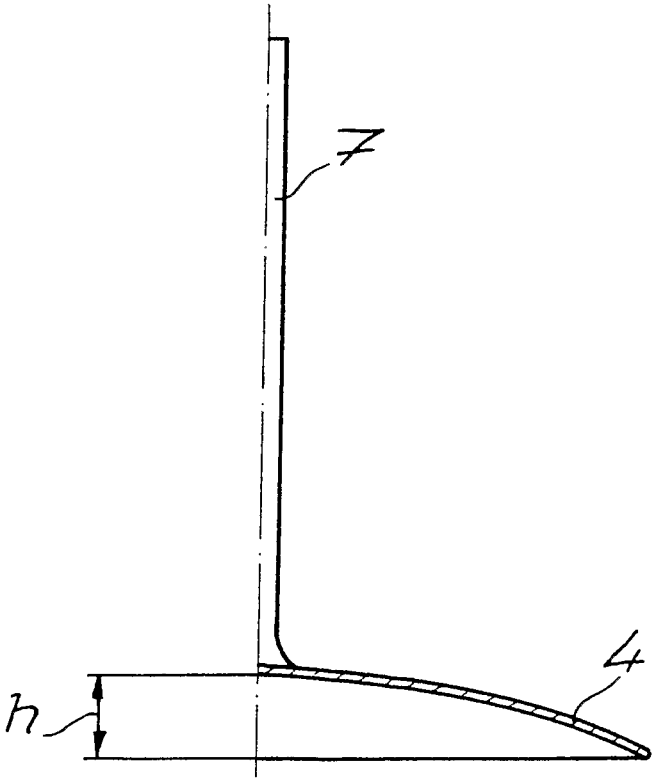
Figure 4:
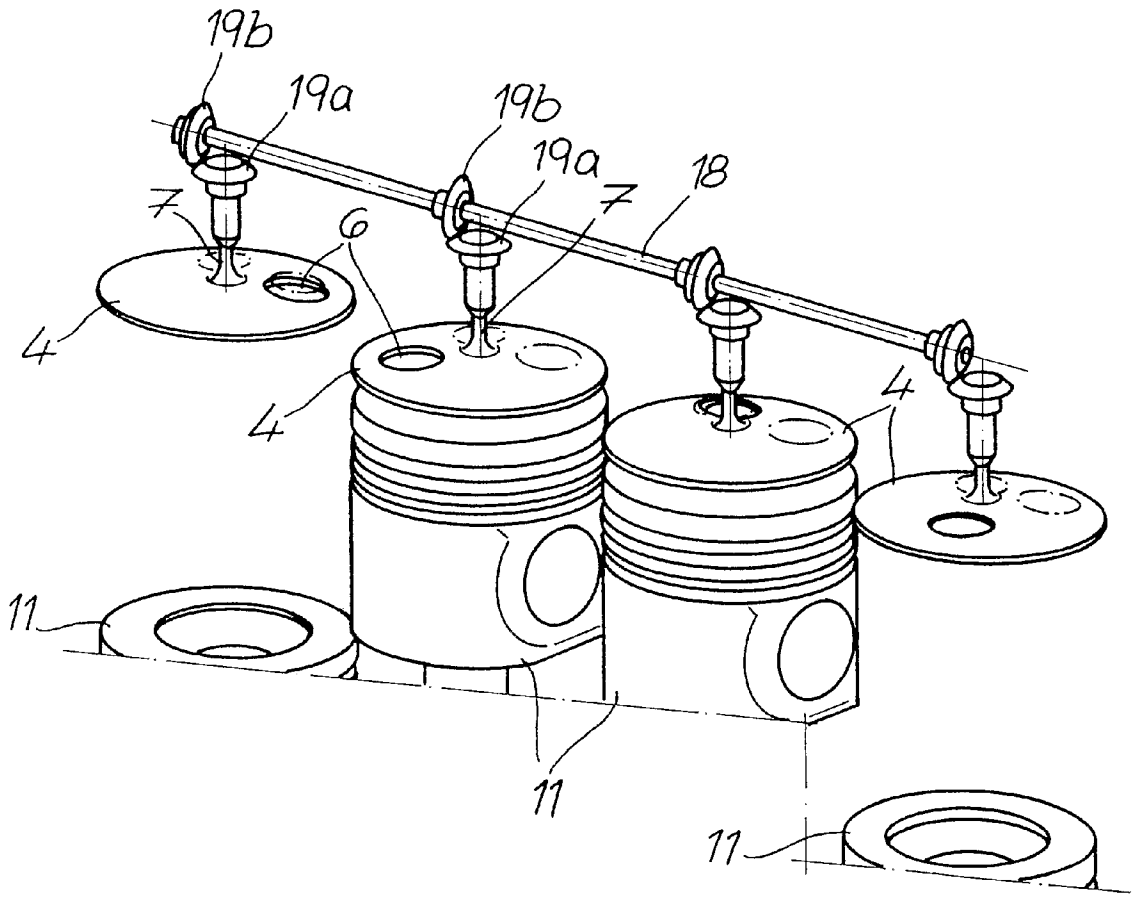
Figure 5:
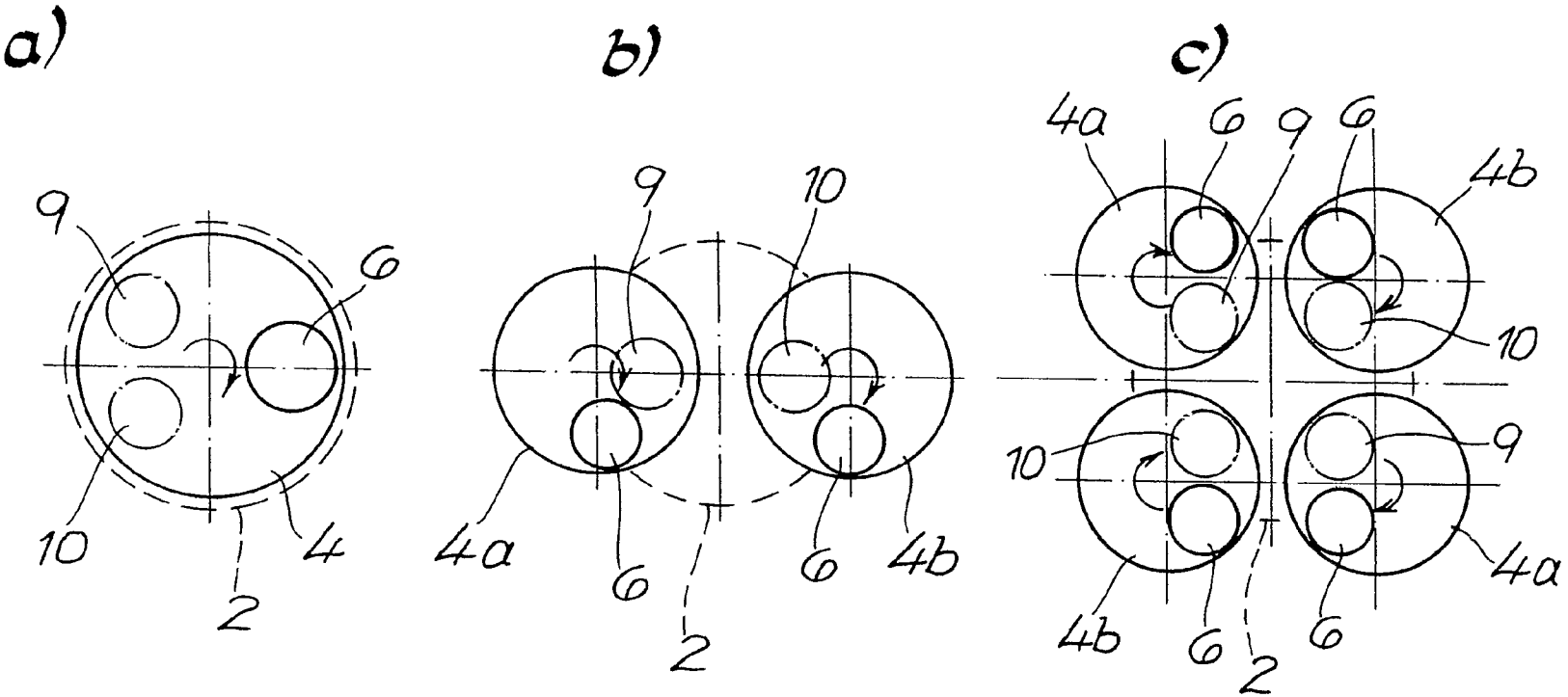

The invention is explained in the following by means of merely a drawing representing an exemplary embodiment. It shows schematically:

FIG. 1*a* a cylinder of an internal combustion engine with an inlet and exhaust valve arrangement according to the invention, wherein a single valve disc is driven by an electronically controlled electric motor;

FIG. 1*b* the arrangement according to FIG. 1*a* in an alternative development with two independent valve discs, wherein the inlet and exhaust ports are driven by independent electric motors;

FIG. 2 a detail view of a valve disc with a assigned shaft assigned to;

FIG. 3*a*-3*d* various configurations for the valve disc;

FIG. 4 an internal combustion engine with four cylinders containing four valve discs driven by a mechanical driver;

FIG. 5*a*-5*c* developments of the internal combustion engine where exactly one valve disc or several valve discs are assigned to each cylinder.

FIG. 1*a* shows a cylinder 2 formed in an engine block 1 of a 4-stroke internal combustion engine for a motor vehicle, wherein the gas exchange in cylinder 2 takes place through an inlet and exhaust valve arrangement 3. The inlet and exhaust valve arrangement 3 is formed through a valve disc 4 and a cylinder head 5 fitted on to the engine block 1, wherein the valve disc 4 has a passage opening 6 and is arranged drivable by a shaft 7 in a rotating manner in the cylinder head 5. The shaft 7 and the valve disc 4 are manufactured of one piece or in different parts. The cylinder head 5 forms a valve seat 8 assigned to the top of the valve disc 4. The cylinder head 5 has an inlet port 9 and an exhaust port 10 as ports which are cyclically opened and closed again by the passage opening 6. The rotation of the valve disc 4 is coupled to the crankshaft rotation angle with half of its RPM. Usually it is provided that the valve disc 4 rotates by 360 degrees with a complete cycle of the 4-stroke internal combustion engine, that means 720 degrees.

The valve disc 4 and the valve seat 8 are curved in the direction of the bottom of the valve disc 4 starting from the shaft 7. The valve disc 4 has a low thickness of typically 0.2 mm to 2 mm, preferably 0.5 mm to 1.5 mm. Due to its low thickness and material the valve disc 4 is elastically pliable and bendable, and during the rotational movement the valve disc 4 is deflected or elastically deformed and the edge of the valve disc 4 is moved in the direction of the assigned to valve seat 8 merely because of its rotational movement. Suitable materials are more preferably metallic materials such as for example titanium or titanium alloys or carbon fiber materials and carbon fiber reinforced materials. Through the deformation of the valve disc 4 the gap between the valve seat 8 and the valve disc 4 is reduced, and as a result of this the increasing of the sealing of the system with low friction can be achieved, contributing to the blow-by reduction.

An alternative development of the invention, wherein two valve discs 4*a*, 4*b* are assigned to a cylinder 2 is shown in FIG. 1*b*. The valve discs 4*a*, 4*b* are assigned to the inlet port 9 and the exhaust port 10, respectively, formed in the cylinder head 5.

The inlet and exhaust valve arrangement 3 shown in FIG. 1*b* also has a control disc 12 with two control openings 13. Here, the control disc 12 can be arranged such that the inlet port 9 and the exhaust port 10 are completely exposed by the two control openings 13. By rotating the control disc 12 relative to the cylinder head 5 it is then possible depending on the operating parameters of the internal combustion engine to reduce the flow cross sections.

Also there is the possibility to have two control discs, one dedicated to the inlet port and another one dedicated to the exhaust port, both control discs with independent regulations. This feature allows the electronic control to provide to the engine more intake or more exhaust flow, depending on the engine application and its operating condition.

FIG. 2 shows the detail view of a valve disc 4 and a shaft 7 which are manufactured in one piece from the same material or in two pieces from different materials. The at least one passage opening 6 of the valve disc 4 is not shown for reasons of clarity. In the exemplary embodiment shown the valve disc 4 has a thickness of 1 mm and a diameter of approximately 100 mm. The height h between the bottom of the valve disc 4 in the area of the shaft 7 on the one hand and in the area of the edge on the other hand can for example amount to 10 mm. Depending on the material selection the change in height through the elastic deformation of the valve disc 4 during its rotation can be in the range from for example microns to several millimeters, and the definitive design depend also on the functional volume of the combustion bowl.

On the valve seat 8 or on the top of the valve disc 4, circumferential sealing lips 14 as shown in FIG. 3*a* can be provided which form a sealing constriction between the valve seat 8 and the valve disc 4. The sealing lips are typically arranged near the edge of the valve disc 4 and are formed as beads from the material of the valve disc 4. Particularly good sealing can be achieved through the arrangement shown in FIG. 3*b*. With this arrangement, sealing lips 14*a*, 14*b*, interacting on the top of the valve disc 4 and on the valve seat 8 are provided which form a labyrinth seal. The location for the sealing lips 14, 14*a*, 14*b* can be optimized as a function of combustion bowl, peak cylinder pressure, rotation and flexibility of the valve disc 4.

Figures 3C, 3D:
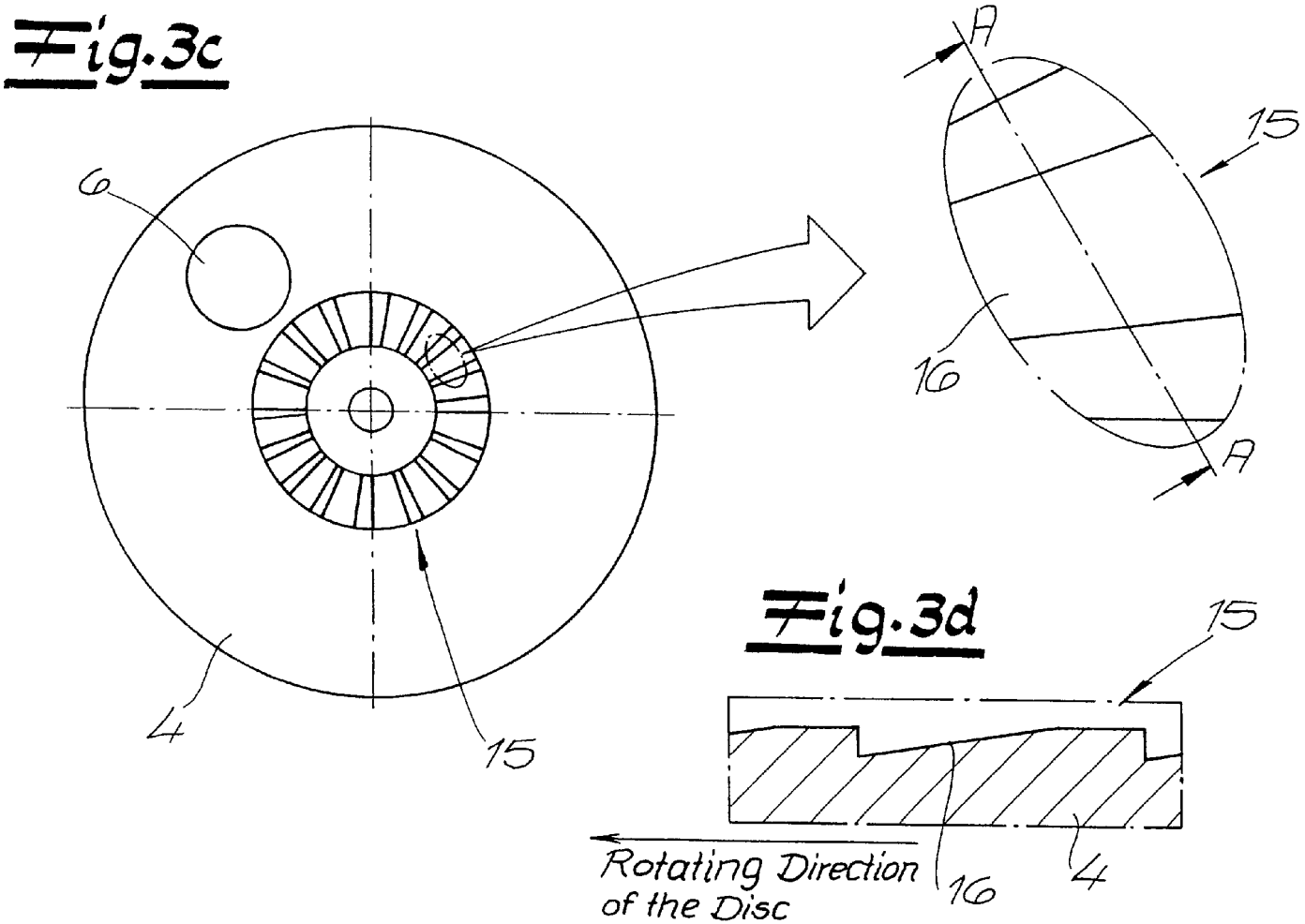

In order to guarantee reliable bearing of the valve disc 4 more preferably at high speeds a surface structuring can be provided on the valve disc 4 and/or on the valve seat 8 which brings about hydrodynamic slide bearing. FIG. 3*c* shows a top view of a suitably structured top of a valve disc 4 wherein FIG. 3*d*, which shows a section along the line A-A of FIG. 3*c* indicates that in an annular section 15, rising wedge surfaces 16 are formed in circumferential direction. Low friction and stiff hydrodynamic bearing can be achieved if a lubricant, for example engine oil, is present between the valve disc 4 and the valve seat 8, generating the amount of lift force required for the low friction losses.

For the inflow of the lubricant a narrow gap 17 is provided in the exemplary embodiment of FIG. 1*a* between the shaft 7 and the assigned accommodation of the cylinder head 5. In order to avoid wear even with direct material contact between seat 8 and the valve disc 4 the valve seat 8 and the valve disc 4 are provided with an appropriated material coating. Also special dimples (or orifices) can be provided in the seat 8 through the head 5 in order to allow the lubricant oil to reach the contact surface of valve disc 4, decreasing the friction losses in this region.

For reasons of clarity, FIG. 4 merely shows the pistons 11 guided in the cylinders 2 of an internal combustion engine with four cylinders 2, the valve discs 4 each assigned exactly to one cylinder with the molded-on shafts 7 and a control shaft 18 for driving the valve discs 4. The control shaft 18 is mechanically coupled to a crankshaft which is not shown. Through the continuous rotation of the control shaft 18 depending on the engine speed the valve discs 4 are driven via bevel gears 19*a*, 19*b*.

There is also the flexibility in terms of assembly in which each of the valve discs have their own driveshaft and these driveshaft can be geared by electronic electric engines. The ECU (Electronic Control Unit) allows the intelligent opening/closing of the inlet and exhaust ports 9, 10 (not shown in FIG. 4) and the turn-on/turn-off of the discs, depending on the engine application.

As can be seen from FIGS. 5*a* to 5*c* exactly one valve disc 4 or several valve discs 4*a* and 4*b* can be assigned to a cylinder 2 within the scope of the present invention. With the arrangement according to FIG. 5*a* the inlet port 9 and the exhaust port 10 are arranged staggered by 90 degree in order to enable gas exchange with opposing stroke movements of the piston 11 with a 4-stroke cycle. With the arrangement according to FIG. 5*b* separate valve discs 4*a*, 4*b* are provided for the inlet port 9 and the outlet port 10 wherein the position of the ports for the purpose of optimum gas exchange can be freely selected. As shown in FIG. 5*c* more than two ports can be provided, wherein in the example shown, two inlet ports 9 and two exhaust ports 10 are arranged crosswise.

The invention claimed is:

1. An inlet and exhaust valve arrangement for an internal combustion engine with a valve disk having at least one passage opening and arranged in a cylinder head drivable by a shaft in a rotating manner and having a valve seat assigned to a top of the valve disk and at least a port that during a rotation of the valve disk is cyclically exposed and closed again by at least one passage opening, the valve disk and the assigned valve seat starting from the shaft running in a curve or taper at an angle toward a bottom of the valve disk, the valve disk being elastically bendable such that during rotation the valve disk is deflected and an edge of the valve disk is moved toward the valve seat to define therewith a self-sealing valve arrangement.

2. The inlet and exhaust valve arrangement according to claim 1 wherein circumferential sealing lips are provided at the top of the valve disk or on the valve seat.

3. The inlet and exhaust valve arrangement according to claim 2 wherein interacting sealing lips that form a labyrinth seal are provided on the top of the valve disk and on the valve seat interacting sealing lips.

4. The inlet and exhaust valve arrangement according to claim 1 wherein wedge surfaces are provided on the top of the valve disk or on the valve seat that bring about hydrodynamic slide bearing during rotation.

5. The inlet and exhaust valve arrangement according to claim 1 wherein the valve disk consists of titanium or a titanium alloy.

6. The inlet and exhaust valve arrangement according to claim 1 wherein the valve disk consists of a carbon fiber material or a carbon fiber reinforced material.

7. The inlet and exhaust valve arrangement according to claim 1 wherein the valve disk or the valve seat has a sliding coating contact surface of nitrides, oxides or carbides of alloys of chromium, aluminum or titanium.

8. The inlet and exhaust valve arrangement according to claim 1 wherein the valve disk has a thickness between 0.2 mm and 2 mm.

9. The inlet and exhaust valve arrangement according to claim 1, further comprising a control disk with at least a control opening, whereby a position of the control opening relative to the passage opening varies the port cross section.

10. The inlet and exhaust valve arrangement according to claim 9 wherein a duct or a gap for passage of lubricant is provided between the shaft and an assigned mounting of the cylinder head.

11. An internal combustion engine for a motor vehicle with an inlet and exhaust valve arrangement according to claim 1, the engine comprising a cylinder head fitted to an engine block with at least one cylinder.

12. The internal combustion engine according to claim 11, wherein there are a plurality of the cylinders, and each cylinder is assigned exactly one valve disk.

13. The internal combustion engine according to claim 12 wherein the valve disks are driven by common control shafts via a gearing or via independent electronic electric motors for each valve disk.

14. The internal combustion engine according to claim 13, wherein each of the shafts of each valve disk has a bevel gear meshing with a bevel gear arranged on a control shaft or via independent electronic electric engines for each valve disk.

15. The internal combustion engine according to claim 11, wherein there are a plurality of the cylinders, and each cylinder is assigned several of the valve disks.

* * * * *